US005741592A

United States Patent [19]

Lewis et al.

[11] Patent Number: 5,741,592

[45] Date of Patent: Apr. 21, 1998

[54] MICROSENCAPSULATED SYSTEM FOR THERMAL PAPER

[75] Inventors: Maurice W. Lewis; John C. Rosenbaum, both of Dayton; Albert J. Herbert, Oxford, all of Ohio; Pankaj Attri, Roorkee, India

[73] Assignee: NCR Corporation, Dayton, Ohio

[21] Appl. No.: 575,656

[22] Filed: Dec. 20, 1995

[51] Int. Cl.[6] ..... B41M 5/26; B41M 5/40

[52] U.S. Cl. ..... 428/402.24; 503/215; 523/211

[58] Field of Search ..... 428/402.24; 503/215, 503/211

[56] References Cited

U.S. PATENT DOCUMENTS

| | | | |
|---|---|---|---|
| 4,370,370 | 1/1983 | Iwata et al. . | |
| 4,388,362 | 6/1983 | Iwata et al. . | |
| 4,424,245 | 1/1984 | Maruta et al. . | |
| 4,444,819 | 4/1984 | Maruta et al. . | |
| 4,444,833 | 4/1984 | Moriguchi et al. | 346/204 |
| 4,507,669 | 3/1985 | Sakamoto et al. . | |
| 4,551,738 | 11/1985 | Maruta et al. . | |
| 4,682,194 | 7/1987 | Usami et al. . | |
| 4,722,921 | 2/1988 | Kiritani et al. . | |
| 4,742,043 | 5/1988 | Tanaka et al. . | |
| 4,749,679 | 6/1988 | Yoshida et al. | 503/208 |
| 4,760,048 | 7/1988 | Kurihara et al. | 503/204 |
| 4,783,439 | 11/1988 | Usami et al. . | |
| 4,842,979 | 6/1989 | Ishige et al. | 430/138 |
| 4,931,420 | 6/1990 | Asano et al. | 427/152 |
| 4,942,150 | 7/1990 | Usami et al. . | |
| 5,443,908 | 8/1995 | Matsushita et al. | 428/913 |

OTHER PUBLICATIONS

Morishita et al. (translation of JP 59019193) (1984).

*Primary Examiner*—Jeffrey Mullis
*Attorney, Agent, or Firm*—Richard J. Traverso

[57] ABSTRACT

A coating formulation which forms a heat sensitive coating and a thermal recording material with such a coating are disclosed. The heat sensitive coating shows improved pre-recording shelf life and improved record stability and consists of microcapsules containing a solid blend of dye and sensitizer, with the exterior of the capsules consisting of color developer and other coating materials such as pigment, binder and additives. Application of heat during printing renders the microcapsule walls permeable to the dye resulting in color development upon reaction of the dye and color developer.

14 Claims, 2 Drawing Sheets

MICROSENCAPSULATED SYSTEM FOR THERMAL PAPER

BACKGROUND OF THE INVENTION

Direct thermal paper is a heat sensitive recording material on which print or design is obtained by the application of heat energy. Thermal paper comprises a base sheet and a coating and like other coated papers, the coating is applied to give new properties to the base sheet and not hide defects and deficiencies. Thermal paper is also similar to other coated papers in that it is influenced by five major processing steps: base stock manufacture, coating preparation, coating application, drying and finishing, with each step being influenced by the base sheet. A major distinction in thermal paper from other coated papers is that special color forming chemicals and additives are present in the coating formulation such that when heat is applied by a thermal head, the color forming chemicals react to develop the desired print or image. The additives in the coating formulation provide for suitable runnability under the thermal head.

The dye-developing type system is the most common type thermal coating. The three main color producing components in a dye-developing type thermal coating are colorless dye (color former), an acidic material (color developer) and sensitizer. These solid materials are reduced to very small particles by grinding and incorporated into a coating along with pigments, binders, and additives. This coating is then applied to the surface of paper or other support system using various types of coating application systems and dried. Images are formed on the coated surface by application of heat to melt and interact the three color producing materials. This common procedure of thermal printing has undesirable problems with prerecording color development and poor shelf life or record stability caused by adverse environmental conditions such as heat, light and humidity. The environmental conditions cause the intimately mixed color forming materials to react and result in premature color development or continued background color development during record storage.

The development of new types of dyes, developers and auxiliary compounds have had limited success in increasing the resistance of thermal papers to environmental conditions and improving image stability. A new approach to protect thermal paper from environmental conditions was developed by producing a barrier or protective layer on top of the thermal coating (U.S. Pat. Nos. 4,370,370; 4,388,362; 4,424,245; 4,444,819; 4,507,669; 4,551,738). Several different types of barrier layers are used like water soluble resins, water soluble polymeric material and water repellent wax or wax-like material. These types of thermal paper are limited to a narrow end use like passenger and coupon tickets and for label sheets used on different packages especially on plastic bags.

The concept of incorporating microcapsules into a coating for thermal paper has been reported (U.S. Pat. Nos. 4,682,194; 4,722,921; 4,742,043; 4,783,439; 4,942,150). According to these patents by Fuji Photo Film Co., a leuco dye dissolved in an organic solvent is microencapsulated. The thermal coating comprising these microcapsules, a developer and other coating materials is applied to a support base. It is claimed that the capsule wall has a glass transition temperature between 70° C. to 150° C. The brief heating of the coating by the thermal head during printing transforms the microcapsule wall from a glassy state to the rubbery state. This allows the color developer outside the capsules to permeate through the capsule wall into the core and react with the dye dissolved in the organic solvent giving the desired image. Two serious problems which are feared in this type system are not clearly addressed in the patents. First, as the capsules have a liquid core containing the dye there is a greater chance of developing fog or undesirable background color if the capsules are broken by mechanical or frictional forces during handling. Second, as surface smoothness of the paper is most important in getting a good uniform image or print on a thermal paper, calendering of thermal paper after coating is a necessary condition. Calendaring is necessary because the thermal paper image is obtained by bringing the thermal head of the printer directly in contact with the paper. If the paper is rough the print obtained will not be uniform. The base sheet selected for thermal paper preferably has more than 300 second Bekk smoothness. This high level of smoothness requires that the final thermal coated sheet be calendared to a high degree. Thus, calendaring is an important step in the process of making a quality thermal paper. It is more likely that capsules having liquid cores will be broken during calendaring and result in fog or background color from ruptured capsules. It is desirable to provide a coating formulation for thermal paper wherein fog or background color is eliminated or reduced.

SUMMARY OF THE INVENTION

It has been discovered that coating formulations for thermal paper containing microencapsulated solid blends of dye and sensitizer provide suitable color forming performance when exposed to a thermal print head while avoiding mechanical damage during handling and processing which can result in fog or background color. One aspect of the invention relates to a coating formulation which provides thermal sensitive coatings and contains microcapsules of solid blends of dye and sensitizer. Another aspect of this invention relates to thermal sensitive recording material with coatings obtained from these coating formulations.

Microencapsulation of solid blends of dye and sensitizer minimizes mechanical damage, which can occur during calendering, finishing and handling in that the microcapsule is impermeable to the dye at room temperature. Application of heat from a thermal printing head will melt the solid dye-sensitizer blend and render the microcapsule permeable to the dye, thus permitting the color development reactions to take place, while capsules in the unprinted background area will remain undamaged and protect the thermal coating from environmental conditions.

-□-=low (0.045 μm, 8% dye)

-♦-=medium (0.06 μm, 8% dye)

-◇-=high (0.07 μm, 8% dye).

Figure 2:
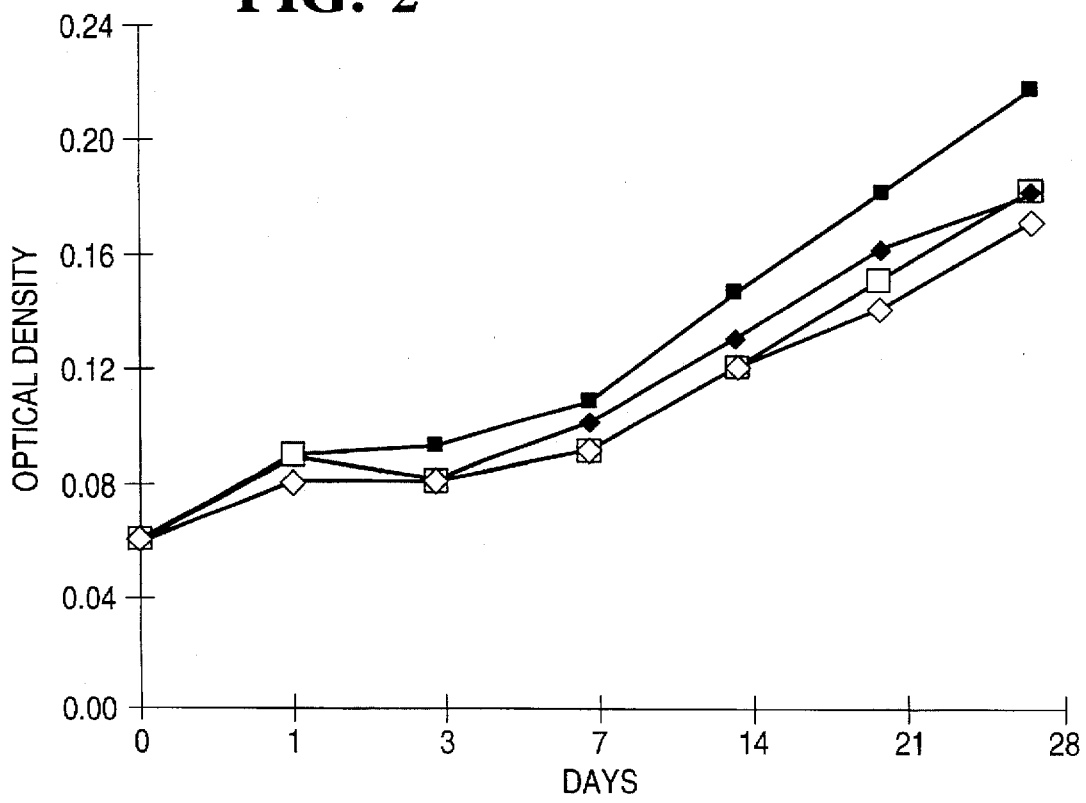

FIG. 2, a graph of optical density over time for various thermal papers under ultraviolet light, wherein -■-=control (10% dye)

-□-=low (0.045 μm, 10% dye)

-♦-=medium (0.06 μm, 10% dye)

-◇-=high (0.07 μm, 10% dye).

Figure 3:
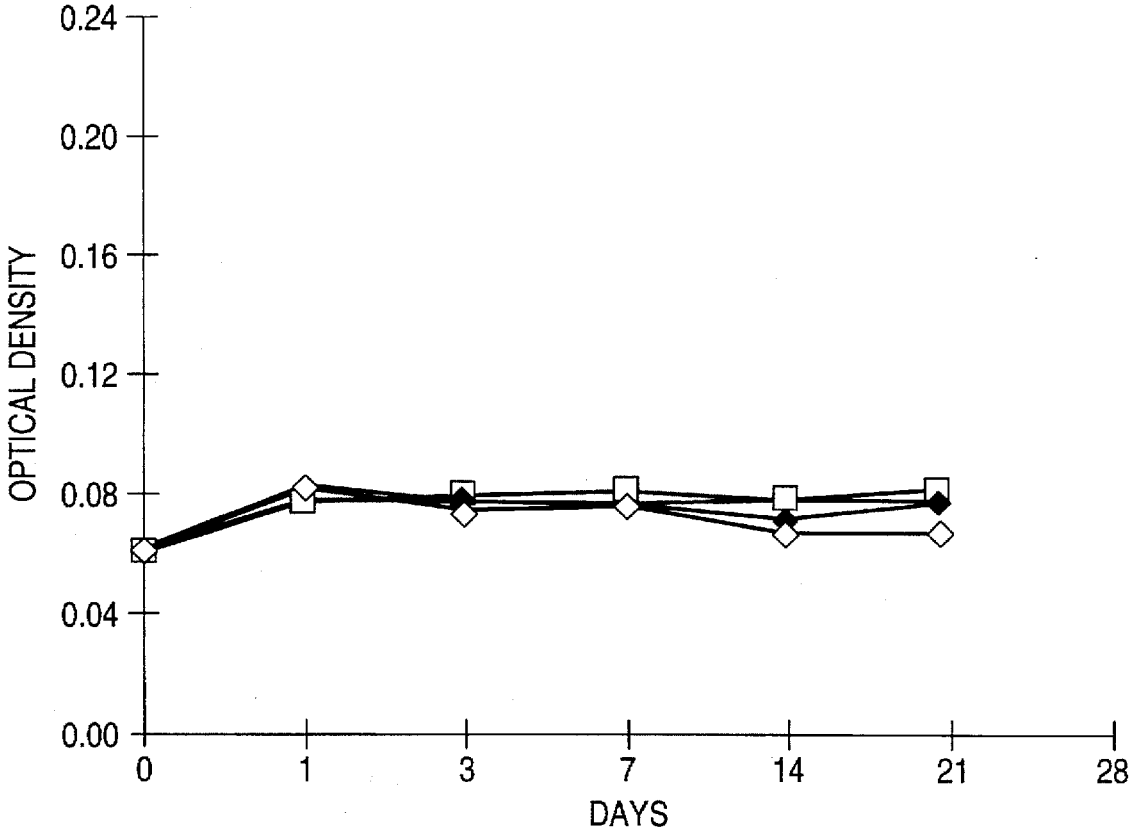

FIG. 3, a graph of optical density over time for various thermal papers at 90° F., 90% relative humidity -■-=control (10% dye)

-□-=low (0.045 μm, 10% dye)

-♦-=medium (0.06 μm, 10% dye)

-◇-=high (0.07 μm, 10% dye).

DETAILED DESCRIPTION OF PREFERRED EMBODIMENTS

The coating formulation of the present invention comprises three main components: a dye (color former), a developer and a sensitizer. Two components which are important but still optional are a pigment and a binder. Other optional components include lubricants, dispersants, defoamers, cell modifiers and insolubilizers.

In the coating formulation of this invention, the dye and sensitizer are employed as a homogeneous blend. The blend is a solid at ambient temperature and is used in particulate form, preferably of the size of from 1 to 2 microns. These particulates are encapsulated in a microcapsule while in solid form. Preferably, this microcapsule is free of solvent.

The color developer is also used as a solid particulate, preferably of a size of from 1 to 2 microns. A liquid vehicle for the solid particulates of the coating composition completes the formulation. Water is a suitable vehicle.

To prepare the coating composition of this invention, dye and sensitizer are typically melted together, thoroughly mixed and solidified to give a homogeneous dye-sensitizer compound. This compound is finely ground into particles of a size in the range of 1 to 2 microns. The particles of this dye-sensitizer compound are then encapsulated in solid form and dispersed in the final coating formulation containing the color developer in particulate form. Applying this coating formulation to a support provides a thermal sensitive coating. Applying the coating formulation to a basesheet provides thermal paper with reduced fog and background color in the thermal sensitive coating.

The colorless dyes suitable for use in this invention are those which become colored when melted and exposed to a color developer. Examples of these dyes are described below. They are typically colorless or white-colored basic substances which become colored when oxidized by specific substances such as acidic compounds. Suitable color developers are described more particularly below. Sensitizers are employed in the coating formulations of the present invention to reduce the melting point of the homogeneous blend below that of the colorless dye. This reduces the amount of heat necessary to melt the dye and obtain reaction with the color developer. This is significant in preparing coating formulations for thermal paper which will be printed on at specific temperatures determined by the thermal printing head. The homogeneous blend must have a melting point below the operating temperature of a thermal print head of a thermal printer. The operating temperature of thermal printers available commercially varies widely, typically within the range from 50° C. to 250° C., and one skilled in the art can readily determine the maximum melting point for the homogeneous blend for a particular application.

In preparing a coating formulation for a particular application, the first step is to obtain a combination of dye and sensitizer suited for use in the equipment to be employed. A versatile combination is one which provides a low melting point, gives a colorless compound and provides good color-forming capability with the color developer. A preferred combination is the dye identified below as ODB-II and the sensitizer m-terphenyl. The two materials are melted, thoroughly mixed and then solidified to get a homogeneous compound. This homogeneous compound is then coarse ground in a mortar and pestle type particle grinder. The coarse powder is then finally ground in an attritor with water and other additives. Defoamer and dispersant are optionally added to give a solids level of about 35%. Particle grinding is continued to a point where particle sizes in the range of 1 to 2 microns are obtained. This typically requires two or more hours of grinding time. The particles are dispersed in the slurry and microencapsulated within a microcapsule by a procedure such as exemplified below.

The microencapsulating material is selected so as to be permeable and provide for exposure of the colorless dye to the color developer upon the application of heat sufficient to melt the dye-sensitizer compound, i.e., at a temperature below the operating temperature of the thermal print head of a thermal printer. Typically, the microcapsule is ruptured at these temperatures. However, diffusion of the colorless dye through the microcapsule wall is possible. To provide permeability for exposure of the colorless dye to the color developer, the microcapsule preferably comprises a material which softens or melts at the melting temperature of the dye-sensitizer compound, i.e., at a temperature below the operating temperature of the thermal print head of a thermal printer. Suitable microcapsules are comprised of polymers based on polycondensation chemistry such as highly cured amino-formaldehyde resins. Capsule walls are preferably less than 1 micron in thickness and most preferably have a thickness of 0.045–0.07 microns.

Prior to encapsulation, the dye-sensitizer particle slurry is preferably dispersed, washed and centrifuged a number of times. Preferably, a high speed agitator is used to obtain a homogeneous dispersion. The slurry is then diluted with an equal volume of water and centrifuged at about 350 rpm until most of the pigment is settled and fines (4 μm) remain suspended in the upper layer of the liquid. This upper liquid layer is discarded and the settled pigment is again dispersed, washed with water and centrifuged. Most preferably, the upper layer is again discarded and the dispersion, washing and centrifuging steps are repeated a third time. The settled dye-sensitizer particles are then collected at approximately 40% solids for encapsulation.

An example of a suitable encapsulation procedure is as follows:

Step 1 Prepare an aqueous solution of the polymer (and any optional additives) which will encapsulate the particles and agitate the solution to provide a continuous medium. A variable speed stirrer fitted with a turbine impeller blade can be used.

Step 2 Disperse into this aqueous solution an amount of dye-sensitizer particle cake to produce capsules of the desired wall thickness.

Step 3 While adjusting temperature and pH, add a phase separation and viscosity control agent. Maintain temperature in the range of 50°–60° C. During this stage, the capsule wall begins to form.

Step 4 Add a second and final portion of polymer.

Step 5 Allow the capsule slurry to stir at an elevated temperature for several hours to achieve complete curing of the capsule wall.

Step 6 Cool the slurry of microcapsules and make any necessary pH adjustments.

Step 7 Dilute with water and remove any oversized particles by passing the slurry through a 45 μm sieve.

Step 8 Centrifuge the slurry to wash out the soluble reactants and any suspended fines. Repeat this washing process two times by dispersing the settled cake in deionized water.

Step 9 Collect the cake and determine the capsule solids by drying a sample in an oven at 100° C.

The particle size of the components in the coating formulation is very important in imparting good color development. Therefore, the color developer is preferably employed as fine particles ground in an attritor to a particle size of 1–2 μm. The dye-sensitizer and color developer grinds are prepared separately to avoid premature color reaction.

The color developer grind is preferably prepared by grinding and dispersing color developer and optional components such as pigment, binder and additives in water. The preferred color developer is Bisphenol A. Typically, the slurry is ground in an attritor what is a jacketed cylindrical vessel having an assembly of agitator and metallic or ceramic balls to give the grinding action. With such an attritor, the color developer grind is prepared by first adding the proper amount of water and optional additives to the agitator tank. Next, color developer and optional pigments are poured into the agitated tank, typically keeping the speed at above 200 rpm. After all the color developer and optional pigments are poured into the tank, the slurry is ground for one and a half hours at a constant agitator speed of about 300 rpm. Any optional binder is then added to the slurry and ground for 15 minutes. The color developer grind is prepared at 35% solids. The optional additives referred to above include defoamers, dispersants, surfactants and insolubilizers. Other additives can also be used as needed.

The final coating formulation is prepared by dispersing the encapsulated dye-sensitizer slurry into the developer grind slurry using a high speed agitator. The necessary amount of microcapsules are added for the final coating to have the desired dye solids.

Color formers suitable for use in the coating formulations and thermal sensitive recording materials of this invention are leuco dyes. Leuco dyes are colorless or light colored basic substances which become colored when oxidized by acidic substances. Examples of leuco dyes that can be used herein are described as follows:

(a) Leuco bases of triphenylmethane dyes represented by formula I:

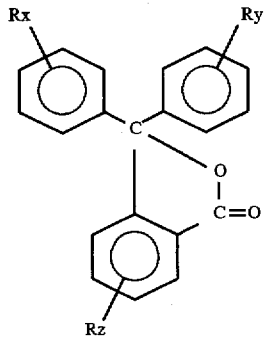

wherein Rx, Ry, and Rz of general formula I can be, independently of each other, hydrogen, hydroxyl, halogen, $C_1$–$C_6$ alkyl, nitro or aryl. Specific examples of such dyes are: 3,3-bis(p-dimethylaminophenyl)-phthalide, 3,3-bis(p-dimethylaminophenyl)-6-dimethylaminophthalide (Crystal Violet Lactone), 3,3-bis(p-dimethylaminophenyl)-6-diethylaminophthalide, 3,3-bis(p-dimethylaminophenyl)-6-chlorophthalide, and 3,3-bis(p-dibutylaminophenyl)-phatalide.

(b) Leuco bases of fluoran dyes represented by formula II:

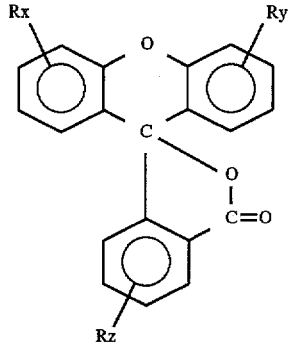

wherein Rx, Ry, and Rz of formula II are as defined above for formula I. Some examples are: 3-cyclohexylamino-6-chlorofluoran, 3-(N-N-diethylamino)-5-methyl-7-(N,N-Dibenzylamino) fluoran, 3-dimethylamino-5,7-dimethylfluoran and 3-diethylamino-7-methylfluoran.

(c) Other suitable fluoran dyes include: 3-diethylamino-6-methyl-7-chlorofluoran, 3-pyrrolidino-6-methyl-7-anilinofluoran, and 2-[3,6-bis(diethylamino)-9-(0-chloroanilino)xanthybenzoic acid lactam].

(d) Lactone compounds represented by formula III:

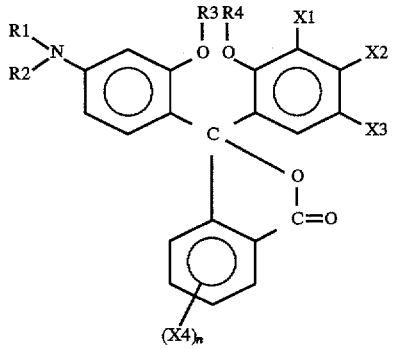

wherein R1 and R2 of formula III, independently of each other, represent hydrogen, unsubstituted $C_1$–$C_6$ alkyl, substituted $C_1$–$C_6$ alkyl, substituted phenyl, unsubstituted phenyl, cyanoethyl, β-halogenated ethyl, or R1 and R2 in combination form a cyclic structure and represent —$(CH_2$—$)_4$, (—$CH_2$—$)_5$ and at least one of R8 and R9 is hydrogen and the other is hydrogen, $C_1$–$C_6$ alkyl, aralkyl, amyl, or phenyl; X1, X2 and X3 each, independently of each other, represent hydrogen, $C_1$–$C_6$ alkyl, halogen, halogenated methyl, nitro, amino or substituted amino and X4 represents hydrogen, $C_1$–$C_6$ alkyl or $C_1$–$C_6$ alkoxy and n is an integer of from 0 to 4. Specific examples of the above-mentioned compounds are: 3-(2'-hydroxy-4'-dimethylaminophenyl)-3-(2'[-methoxy-5'-chlorophenyl) phthalide, 3-(2'-hydroxy-4'-dimethylaminophenyl)-3-(2'-methoxy-5'-nitrophenyl-phthalide, 3-(2'-hydroxy-4'-diethylaminophenyl)-3-(2'-methoxy-5'-methylphenyl) phthalide, and 3-(2'-methoxy-4'-dimethylaminophenyl)-3-(2'-hydroxy-4'-chloro-5'-methylphenyl)-phthalide.

There are many substances which change the color of the dyes by oxidizing them and function as developers. Color developers suitable for the coating formulations and thermal sensitive recording materials of this invention are phenol compounds, organic acids or metal salts thereof and hydroxybenzoic acid esters.

Preferred color developers are phenol compounds and organic acids which melt at about 50° to 250° C. and are sparingly soluble in water. Examples of phenol compounds include 4,4'-isopropylene-diphenol (bisphenol A), p-tert-butylphenol, 2-4-dinitrophenol, 3,4-dichlorophenol, p-phenylphenol, 4,4-cyclohexylidenediphenol. Useful examples of organic acid and metal salts thereof include 3-tert-butylsalicylic acid, 3,5-tert-butysalicylic acid, 5-a-methylbenzylsalicylic acid and salts thereof of zinc, lead, aluminum, magnesium or nickel. Some of the color developers are shown below.

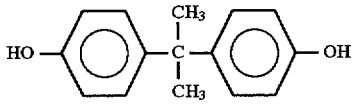

2,2-bis(4'-hydroxyphenyl)propane

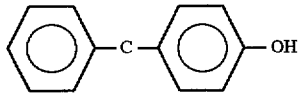

p-phenyl phenol

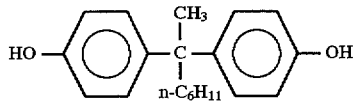

2,2-bis(4'-hydroxyphenyl)-n-heptane

-continued

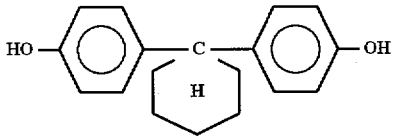

4,4'-cyclohexylidene phenol

Sensitizers or thermosensitivity promoter agents are used in the coating formulation and thermal papers of the present invention to give a good color density. The exact mechanism by which the sensitizer helps in the color forming reaction is not well known. It is generally believed that the sensitizer forms a eutectic compound with one or both of the color forming compounds. This brings down the melting point of these compounds and thus helps the color forming reaction to take place with ease at a considerably lower temperature. Some of the common sensitizers which are suitable are fatty acid amide compounds such as acetamide, stearic acid amide, linolenic acid amide, lauric acid amide, myristic acid amide, methylol compounds or the above mentioned fatty acid amides such as methylenebis (stearamide), and ethylenebis (stearamide), and compounds of p-hydrozybenzoic acid esters such as methyl p-hydroxybenzoate, n-propyl p-hydroxybenzoate, isopropyl p-hydroxybenzoate, benzyl p-hydroxybenzoate.

The electron transfer reaction between a dye and a developer which results in color formation can be shown by the following example:

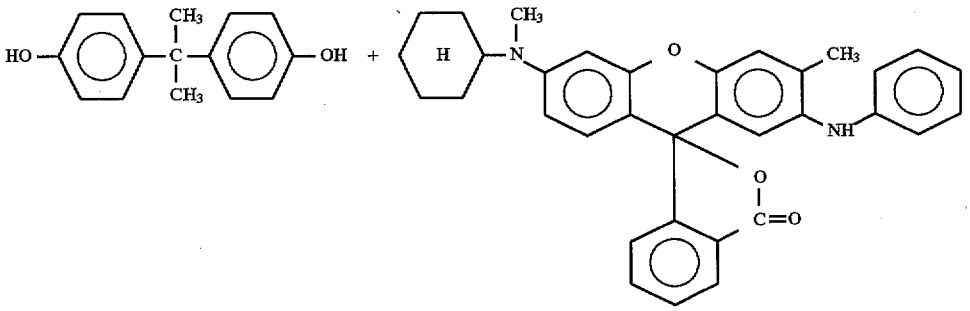

2,2-bis(4'-hydroxyphenyl)propane PSD-150

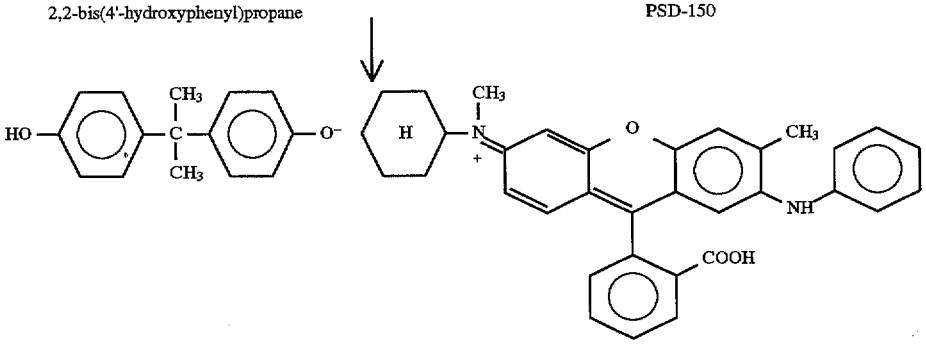

2,2-bis(4'-hydroxyphenyl)propane PSD-150 complex

In producing the coating formation of this invention, the binder is an important ingredient where the pigment is used. In addition to its primary role of binding the pigment to the raw stock, the binder performs several other important functions. The binder, also referred to as the adhesive, is the dominant ingredient in the aqueous phase of the formulation. Thus, it plays a major role in determining viscosity, rheology, water release, and set time for the coating. Binders such as polyvinyl alcohol, methoxycellulose, hydroxyethylcellulose, carboxymethylcellulose, polyvinylpyrrolidone, polyacrylamide, polyacrylic acid, starch, gelatin, and water emulsions of polystyrene, copolymer of vinyl chloride and vinyl acetate, and polybutylmethacrylate are suitable for the coating formulations and thermal sensitive recording materials of this invention.

Conventional pigments that can be used in the coating formulations and thermal paper herein are fine powdered calcium carbonate, silica, alumina, magnesia, talc, baruim sulfate, aluminum stearate or the like. Some lubricants which can also be added to the thermal coatings to make the thermal paper more suitable for use with thermal heads are linseed oil, tung oil, wax, paraffin, polyethylene wax, and chlorinated paraffin. Other additives like dispersants, defoamers, flow modifiers and insolubilizers can also be used.

In the preparation of the thermal paper according to this invention, a suitable base sheet is first chosen as it's optical and mechanical properties significantly affect the final properties of the thermal paper. The material for the coating formulation is then selected. Once prepared, an airknife, blade, or rod coater can be used to apply the coating formulation to the base sheet. The paper is then dried generally by an air dryer and then taken to a finishing section where the paper is calendered, sheeted, etc. In drying the paper, flow and temperature of the air must be properly controlled as the coating is sensitive to heat. In selecting the dye, developer and sensitizer, consideration should be given to the printer head to be used and use will also determine the microcapsule that is employed to encompass the particulates of dye and sensitizer.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosure of all applications, patents and publications, cited above and below, are hereby incorporated by reference.

EXAMPLE 1

The coating formulation for this encapsulated sample had 8% dye solids and a capsule wall thickness of 0.06 μm. Also, the capsule slurry had the following specifications:

| | |
|---|---|
| Total Capsule Slurry | 100 g |
| Total Solids | 40% |
| Core Weight (for 0.06 μm wall thickness) | 79.2% |
| Dye Sensitizer Ratio (for 8% dye solids) | 1:1.93 |
| Calculations: | |
| Total Solids | (100) 0.40 = 40.00 g |
| Core Weight | (40) 0.792 = 31.68 g |
| Dye | 31.68/2.93 = 10.82 g |
| Sensitizer | (31.68 − 10.82) = 8.32 g |

-continued

| Color Developer Grind: | |
|---|---|
| Color Developer (BIS A) | 24.10% Solids |
| Calcium Carbonate | 38.12 |
| Silica | 9.63 |
| Binder (PVA) | 10.84 |
| Water | 00.00 |
| | 100.00 |

The amount of developer grind needed for the capsule slurry is calculated as follows:

[dye solids/(solids in developer grind+solids in capsule slurry)] 100=percent of dye solids in final coating color

[10.82/(0.35*amount of developer grind+40)]=0.08

Amount of developer grind=272.14 g

Therefore, the capsule slurry would be dispersed in 272.14 g of developer grind. The final coating color formulation for the encapsulated samples is as follows:

Coating Color For Encapsulated Sample:

| Chemical | Solids (%) |
|---|---|
| Dye (ODB-II) | 8.00 |
| Sensitizer (m-terphenyl) | 15.42 |
| Developer (Bisphenol A) | 16.97 |
| Calcium Carbonate | 26.84 |
| Silica | 6.78 |
| Wall Material | 6.15 |
| Binder (Polyvinyl Alcohol) | 7.63 |
| Additives | 12.21 |
| Water | 0.00 |
| | 100.00 |

EXAMPLE 2

This example demonstrates the effect of microencapsulation of the dye-sensitizer blend on thermal paper unprinted background color development. Dye-sensitizer particles were prepared and encapsulated as described in Example 1 above with capsule wall thicknesses of 0.045 μm, 0.06 μm and 0.07 μm. The final thermal coatings were prepared with 6%, 8% and 10% dye solids based on calculations as shown in Example 1. The coatings were applied at a coat weight of 17 grams per square meter (gsm) to a bleached basesheet of 45 gsm, 80 brightness and 74 opacity. The coating colors were applied on each basesheet sample using a bench type Time-Life puddle blade coater. The coater had a blade assembly and a backing roll which was rotated with the help of a crank shaft. A highly flexible blade was selected for the coater in order to get a good uniform coat weight. The blade was made of Tempered Spring Steel with 0.003 inch thickness and 3.0 inch width. The same blade was used to make all of the thermal paper samples. The coat weight was maintained at 17 gsm. The sheets were air dried and cut into the required size which were then calendered using a gloss calender at a constant nip pressure of 1200 pli. As the basesheet, coating material, and calendering conditions were kept constant, the samples were prepared at a constant smoothness of 800+/−50 Bekk.

The dye, sensitizer and color developer used were those described in Example 1. The non-color forming materials used in the coating formulation had the following specifications:

| | |
|---|---|
| Calcium Carbonate: | |
| Particle shape | Acicular |
| Particle size | Length = 0.5 to 2.5 μm<br>Thickness = 01 to 0.8 μm |
| Surface area | 20,000 sq cm/gm |
| Dry brightness | 97.0% |
| Specific gravity | 2.8 |
| Apparent gravity | Packed = 13 lb/cu ft<br>Loose = 27 lb/cu ft |
| Silica: | |
| Chemical Properties: | |
| pH (5% in water) | 6–8 |
| Total volatiles | 10% |
| silica | 99% |
| Na2O | 0.3% |
| SO4 | 0.2% |
| Physical Properties: | |
| Surface area | 275 sq m/gm |
| Oil absorption | 275 lb/100 lb |
| Bulk density | 4–6 lb/cu ft |
| Particle size | 2.0 μm |

Polyvinyl Alcohol:

A fully hydrolyzed grade of PVA was used. It was about 5% soluble in water at room temperature. The PVA cook was prepared by pouring PVA powder into the calculated amount of water with constant agitation. The solution was heated to 200° F. with a steam jacketed vessel while maintaining constant agitation. The solution was kept at 200° F. for 30 minutes to complete the dissolution. The PVA was prepared at 12% solids and any water lost during heating was added to the solution.

Additives:

The additives used in the grind preparations were the necessary amounts of defoamer, dispersant, surfactant and insolubilizer to give desired performance of the formulation.

Unprinted background color formation was evaluated for three standard test conditions developed by the industry to represent normal environmental conditions. These test conditions are 120° F./dry, 90° F./90% relative humidity, and ultra violet light. A control sample without encapsulation was included for comparison with the encapsulated samples. The samples were kept in the test conditions for a period of 28 days. Optical density readings were taken at intervals of 1, 3, 7, 14, and 28 days to measure color development. All samples used in the tests were calendered. Examples of the results for each test condition are discussed below to demonstrate the effect of dye encapsulation on background color formation.

Figure 1:
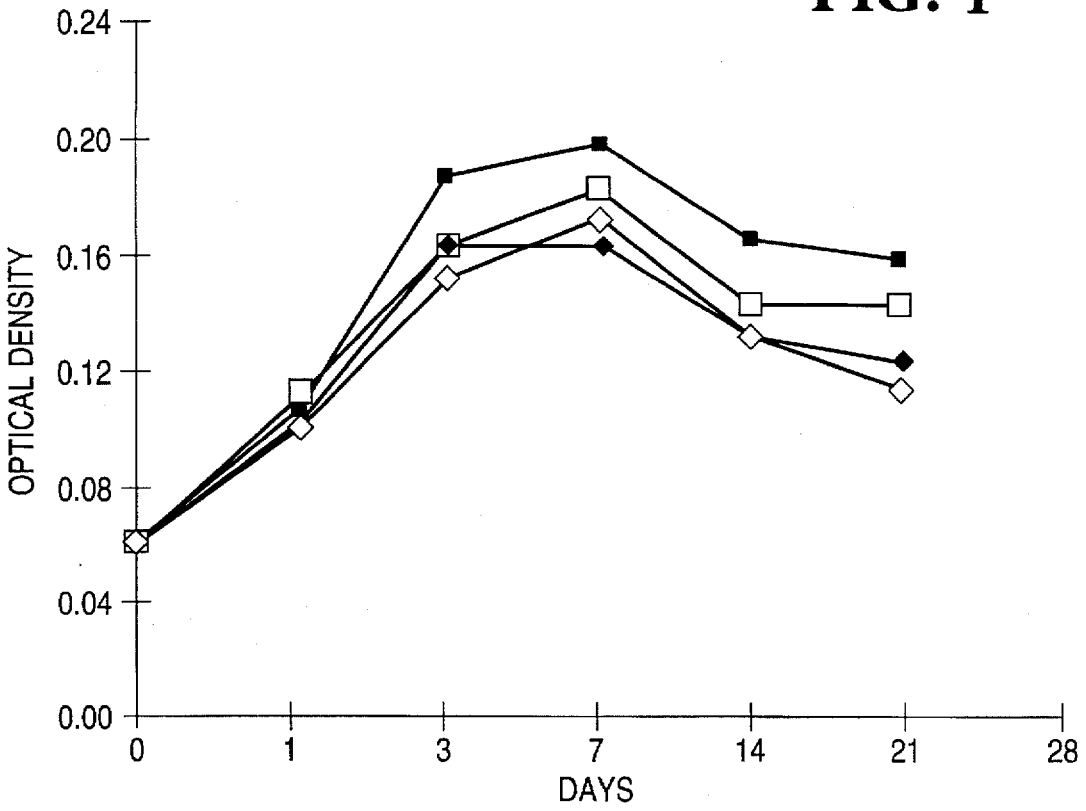
FIG. 1, a graph of optical density over time for various thermal papers at 120° F./dry conditions, wherein -■-=control (8% dye)

The results for the 8% dye addition samples conditioned at 120° F./dry are presented in FIG. 1. The initial optical density of 0.06 was that of the calibration white surface. The results show that the very intense conditions of 120° F./dry had a background color development peak in just 7 days followed by a decreasing pattern. This is explained by the process of color formation and color fading occurring simultaneously in the very intense 120° F./dry test conditions. Color formation was the dominant phenomenon for the first 7 days after which fading became dominant. The results show the decrease in background color development with capsule protection and the effect of increasing capsule wall thickness. The results clearly show that undesirable background color development for the new thermal coating has been reduced by encapsulation of the dye-sensitizer particles compared to the regular thermal coating. The encapsulated dye-sensitizer particles has provided a protective barrier that prevents the environmental conditions from causing premature color development. The results further show that capsule wall thickness has a direct effect on background color development. Increased capsule wall thickness shows reduced background color development.

The results for the 10% dye addition samples conditioned with ultra violet light are presented in FIG. 2. The results again clearly show the decrease in background color development with capsule protection and the effect of increasing capsule wall thickness. The ultra violet light conditions were not as intense as the 120° F./dry conditions. This is indicated by the lack of the maximum color formation in the first 7 day period. The less intense ultra violet light conditions show a gradual increase of background color formation. However, while the effect of the ultra violet light was not as intense as the 120° F./dry conditions, the encapsulated dye-sensitizer particles show the reduced color formation resulting from the capsule wall acting as a barrier to the environmental conditions.

The results for the 10% dye addition samples conditioned at 90° F./90% RH are presented in FIG. 3. The very mild conditions of this test did not show any significant background formation during the 28 day test period for the control samples without encapsulation of the encapsulated samples. These mild environmental conditions simply were not strong enough to cause any color reaction during the 28 day test period.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A coating formulation which provides thermal sensitive coatings for thermal paper, said coating formulation comprising:

(a) microcapsules containing solid particles of a homogenous blend of a colorless dye and a sensitizer, said sensitizer which is free of color develops having a melting point below that of the colorless dye, wherein the homogenous blend melts at a temperature below the melting point of the colorless dye and below the operating temperature of a thermal print head of a thermal printer in the range of 50° C. to 250° C.;

(b) solid particles of a color developer; and (c) a liquid vehicle for the microcapsules of (a), and particles of (b);

wherein the colorless dye develops color when exposed and reacted with the color developer; and wherein the microcapsule is impermeable to said colorless dye at room temperature but ruptures to expose and react the colorless dye with the color developer at the operating temperature of a thermal print head of a thermal printer in the range of 50° C. to 250° C.

2. A coating formulation as in claim 1, wherein the microcapsules contain solid particles of a size less than 2 μm.

3. A coating formulation as in claim 1, wherein the microcapsule melts at a temperature at or below the melting point of the homogeneous blend of colorless dye and sensitizer.

4. A coating formulation as in claim 1, wherein the colorless dye is a leuco dye.

5. A coating formulation as in claim 1, wherein the colorless dye is selected from the group consisting of (a) Leuco bases of triphenylmethane dyes of formula I:

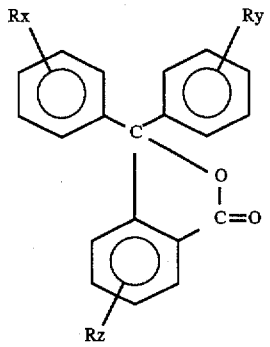

wherein Rx, Ry, and Rz of general formula I can be independently of each other, hydrogen, hydroxyl, halogen, $C_1$–$C_6$ alkyl, nitro, or aryl, (b) Leuco bases of fluoran dyes of formula II:

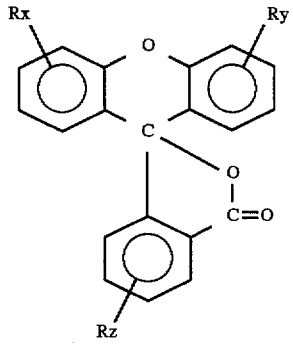

wherein Rx, Ry, and Rz of formula II are as defined above for formula I; and (d) Lactone compounds of formula III:

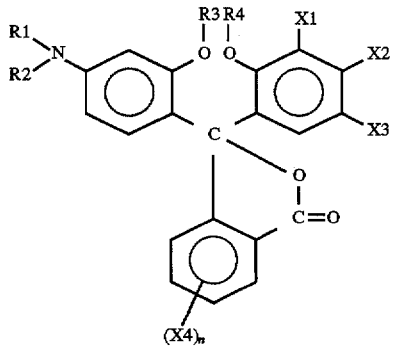

wherein R1 and R2 of general formula III represent hydrogen, unsubstituted $C_1$–$C_6$ alkyl, substituted $C_1$–$C_6$ alkyl, substituted phenyl, unsubstituted phenyl, cyanoethyl, β-halogenated ethyl, or R1 and R2 in combination form a cyclic structure and represent —$(CH_2—)_4$, $(—CH_2—)_5$ and at least one of R3 and R4 is hydrogen and the other is hydrogen, $C_1$–$C_6$ alkyl, aralkyl, amyl or alkyl phenyl, X2 and X3 each represent hydrogen, $C_1$–$C_6$ alkyl, halogen, halogenated methyl, nitro, amino or substituted amino and X4 represents hydrogen, $C_1$–$C_6$ alkyl or $C_1$–$C_6$ alkoxy and n is an integer from 0 to 4.

6. A coating formulation as in claim 1, wherein the color developer is selected from phenol compounds, organic acids of phenol compounds, organic acids, metal salts of organic acids and esters of organic acids which melt at about 50° to 250° C.

7. A coating formulation as in claim 1, wherein the color developer is selected from the group consisting of phenol compounds, organic acids or metal salts thereof and hydroxybenzoic acid esters which melt at about 50° to 250° C.

8. A coating formulation as in claim 1, wherein the sensitizer is selected from fatty acid amide compounds, methylol compounds of the fatty acid amides and p-hydroxybenzoate acid esters.

9. A coating formulation as in claim 1, wherein the sensitizer is selected from the group consisting of acetamide, stearic acid amide, linolenic acid amide, lauric acid amide, myristic acid amide, methylenebis (stearamide), ethylenebis (stearamide), and methyl p-hydroxybenzoate, n-propyl p-hydroxybenzoate, isopropyl p-hydroxybenzoate, benzyl p-hydroxybenzoate.

10. A coating formulation as in claim 1, wherein the microcapsule is comprised of amino formaldehyde resin.

11. A coating formulation as in claim 1, wherein the microcapsule has a wall thickness of from 0.045 to 0.07 μm.

12. A coating formulation as in claim 1 additionally comprising a binder and pigment.

13. A coating formulation as in claim 12, additionally comprising a dispersant, defoamer, flow modifier and/or insolubilizer.

14. A coating formulation as in claim 2, wherein the contents of the microcapsule are free of organic solvent which is liquid at ambient temperature.

* * * * *

UNITED STATES PATENT AND TRADEMARK OFFICE

CERTIFICATE OF CORRECTION

PATENT NO. : 5,741,592

DATED : Apr. 21, 1998

INVENTOR(S) : Maurice W. Lewis et al.

It is certified that error appears in the above-indentified patent and that said Letters Patent is hereby corrected as shown below:

On the title page: Item

"[75], "Herbert" should be --Herbet--

Signed and Sealed this

Eighth Day of December, 1998

Bruce Lehman

*Attest:*

BRUCE LEHMAN

*Attesting Officer*

*Commissioner of Patents and Trademarks*